US009617666B2

(12) United States Patent
Huang

(10) Patent No.: US 9,617,666 B2
(45) Date of Patent: Apr. 11, 2017

(54) COFFEE YARN AND FABRIC USING THE SAME

(71) Applicant: Cheng-Chun Huang, Lugang Township, Changhua County (TW)

(72) Inventor: Cheng-Chun Huang, Lugang Township, Changhua County (TW)

( * ) Notice: Subject to any disclaimer, the term of this patent is extended or adjusted under 35 U.S.C. 154(b) by 0 days.

(21) Appl. No.: 14/959,761

(22) Filed: Dec. 4, 2015

(65) Prior Publication Data

US 2017/0002485 A1 Jan. 5, 2017

(30) Foreign Application Priority Data

Jul. 1, 2015 (TW) ..... 104210604 U

(51) Int. Cl.
*D03D 15/00* (2006.01)
*D01F 1/10* (2006.01)

(52) U.S. Cl.
CPC ..... *D03D 15/0027* (2013.01); *D01F 1/10* (2013.01); *D03D 15/00* (2013.01)

(58) Field of Classification Search
CPC ... D01F 1/10; D02G 3/02; D02G 3/04; D03D 5/00
See application file for complete search history.

(56) References Cited

U.S. PATENT DOCUMENTS 3,499,851 A * 3/1970 Ligo ..... C08L 99/00 106/407
8,834,753 B2 * 9/2014 Hung ..... D01F 1/10 264/211
2002/0173583 A1 * 11/2002 Shimizu ..... C08J 5/045 524/515
2009/0100655 A1 * 4/2009 Hung ..... D01F 1/10 28/100
2010/0022150 A1 * 1/2010 Hung ..... D01F 1/10 442/304
2014/0349537 A1 * 11/2014 Hung ..... D01F 1/10 442/202
2015/0299904 A1 * 10/2015 Weiser ..... D01F 6/60 428/36.1

FOREIGN PATENT DOCUMENTS

| | | | |
|---|---|---|---|
| CN | 104228163 | A | 12/2014 |
| CN | 104249498 | A | 12/2014 |
| CN | 204625900 | U | 9/2015 |
| TW | 201107545 | A1 | 3/2011 |
| WO | WO 2013/121417 | A1 | 8/2013 |

* cited by examiner

*Primary Examiner* — Bobby Muromoto, Jr.
(74) *Attorney, Agent, or Firm* — Birch, Stewart, Kolasch & Birch, LLP

(57) ABSTRACT

A coffee yarn and a fabric using the same are provided herein and the fabric includes a plurality of coffee yarns and a plurality of weaving yarns. The coffee yarns are arranged in parallel and each one of the coffee yarns includes a yarn body and multiple coffee particles. The yarn body has a wavy strip shape and includes a plurality of bending sections and a plurality of non-bending sections. The coffee particles are embedded within the yarn body. A density of the coffee particles in the bending sections is greater than a density of the coffee particles in the non-bending sections. The weaving yarns are arranged in parallel and the weaving yarns are alternately weaved with the coffee yarns.

12 Claims, 3 Drawing Sheets

COFFEE YARN AND FABRIC USING THE SAME

CROSS-REFERENCE TO RELATED APPLICATIONS

This application claims the benefit of Taiwan patent application No. 104210604, filed on Jul. 1, 2015, the disclosure of which is incorporated herein in its entirety by reference.

BACKGROUND OF THE INVENTION

1. Field of the Invention

The present invention relates to a fabric, and more particularly to a coffee yarn and the fabric using the same.

2. Description of Related Art

Weaving is a skill to repeatedly overlap yarns so as to form a flat or a three-dimensional fabric. The yams may be processed to form a specific shape in accordance with personal requirement before the weaving.

For example, the yarns may be processed to form a wavy shape before the weaving. The yarns with the wavy shape can increase a contact area between the fabric and human skins. However, the conventional fabric is difficult to include some extensive functions, such as odor absorption, fast dry, and so on. Therefore, the drawback of the conventional fabric really needs to be improved.

SUMMARY OF THE INVENTION

In order to solve the problem that the conventional fabric is difficult to include some extensive functions, such as odor absorption, fast dry, and so on, an objective of the present invention is to provide a coffee yarn and a fabric using the same to solve the conventional problems.

The coffee yam of the present invention comprises:

a yarn body in a wavy strip shape and including a plurality of bending sections and a plurality of non-bending sections; and a plurality of coffee particles embedded within the yarn body, and a density of the coffee particles in the bending sections being greater than the density of the coffee particles in the non-bending sections.

The coffee yarn may be made by Nylon, Polyethylene, Polypropylene or Polyester.

The fabric with coffee yarns of the present invention comprises:

a plurality of coffee yarns arranged in parallel, and each one of the coffee yarns including:

- a yarn body in a wavy strip shape and including a plurality of bending sections and a plurality of non-bending sections; and
- a plurality of coffee particles embedded within the yarn body, and a density of the coffee particles in the bending sections being greater than the density of the coffee particles in the non-bending sections; and a plurality of weaving yarns arranged in parallel, and the weaving yarns alternately weaved with the coffee yarns.

In the fabric with coffee yarn, the yarn body of the coffee yarn may be made by Nylon, Polyethylene, Polypropylene or Polyester.

According to the aforementioned technical means, the advantage of the present invention is that the fabric having coffee yarn with coffee particles includes several different extensive capabilities, such as fast dry, odor absorbing, deodorization, UV rays blocking and so on. The usage of the fabric with coffee yarns can be diverse.

DETAILED DESCRIPTION OF THE PREFERRED EMBODIMENT

These and other aspects of the embodiments herein will be better appreciated and understood when considered in conjunction with the following description and the accompanying drawings.

Figure 1:
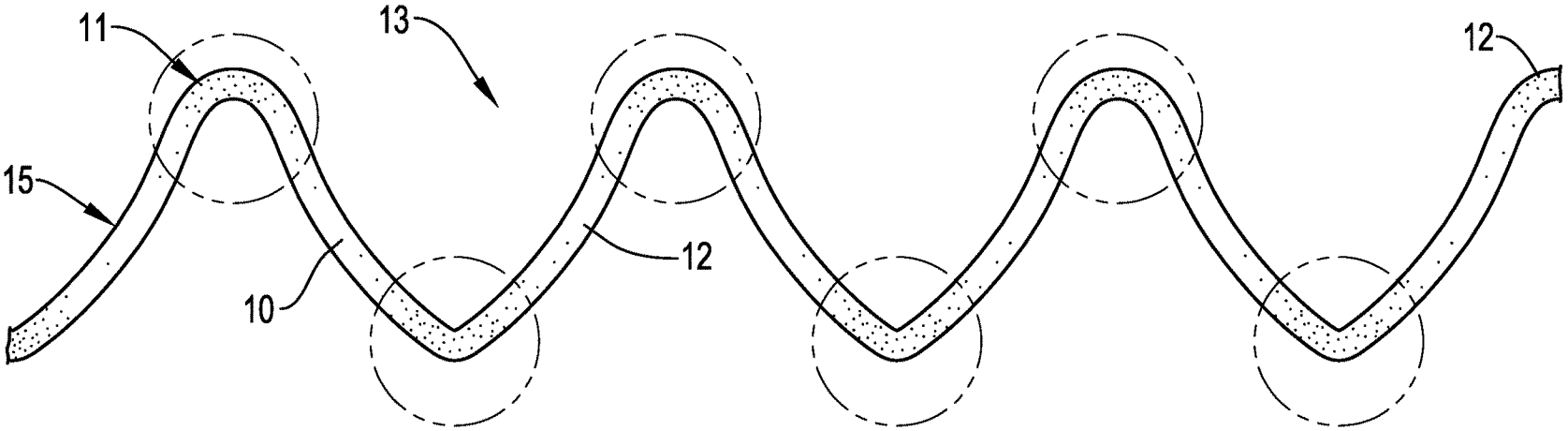
FIG. 1 is a schematic view of a coffee yarn provided in a preferred embodiment of the present invention.

With reference to FIG. 1, a coffee yarn 13 of an embodiment of the present invention includes a yarn body 10 and a plurality of coffee particles 12. The yarn body 10 is formed in a wavy strip shape and includes a plurality of bending sections 11 and a plurality of non-bending sections 15. The bending sections 11 are respectively and alternately connected with the non-bending sections 15. The coffee particles 12 are embedded within the yarn body 10. The coffee particles 12 are concentrated within the bending section 11 of the yarn body 10. In other words, a density of the coffee particles in the bending sections 11 is greater than a density of the coffee particles in the non-bending sections 15.

The yarn body 10 may be made by Nylon, Polyethylene, Polypropylene or Polyester. However, the material of the yarn body 10 is not limited herein.

Figure 2A:
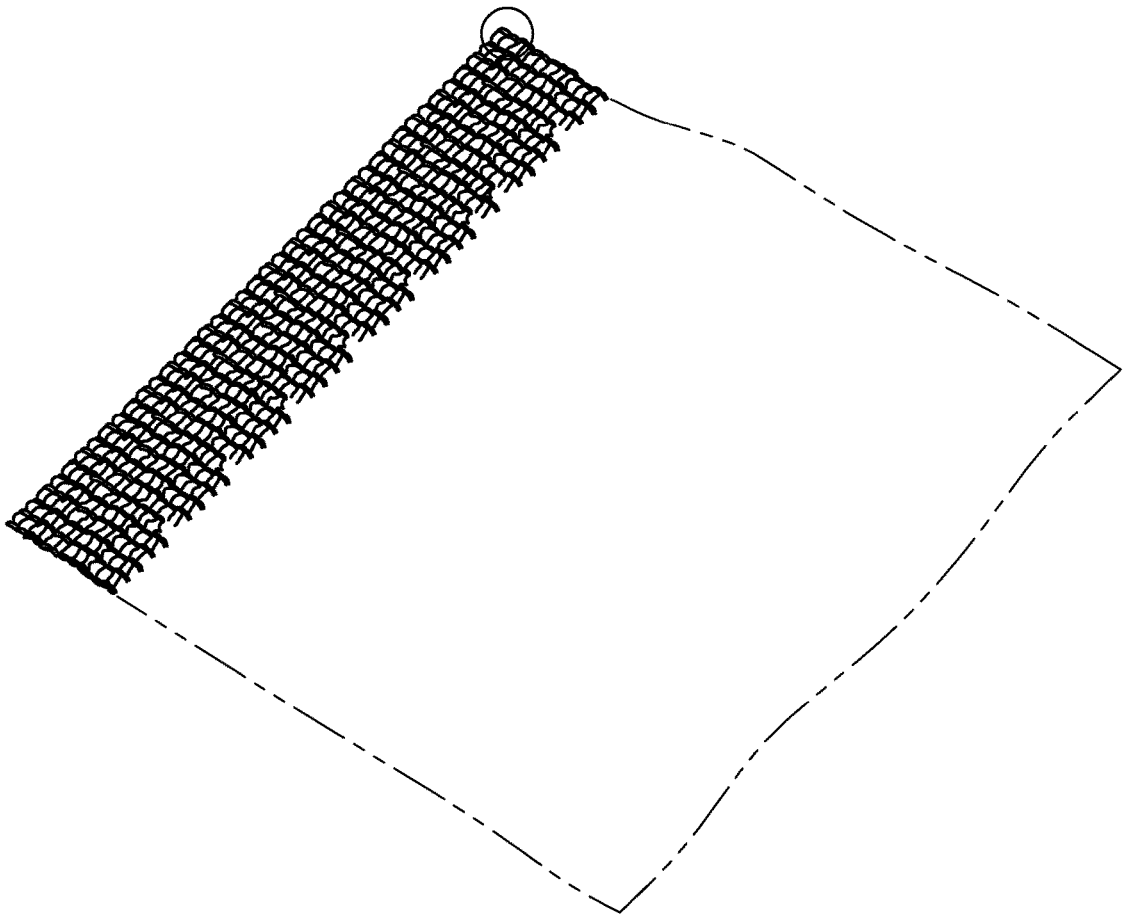
FIG. 2A and FIG. 2B are schematic views of a fabric with coffee yarns provided in the preferred embodiment of the present invention.
Figure 2B:
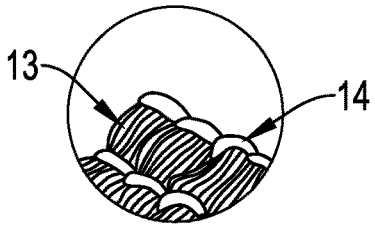
Figure 3:
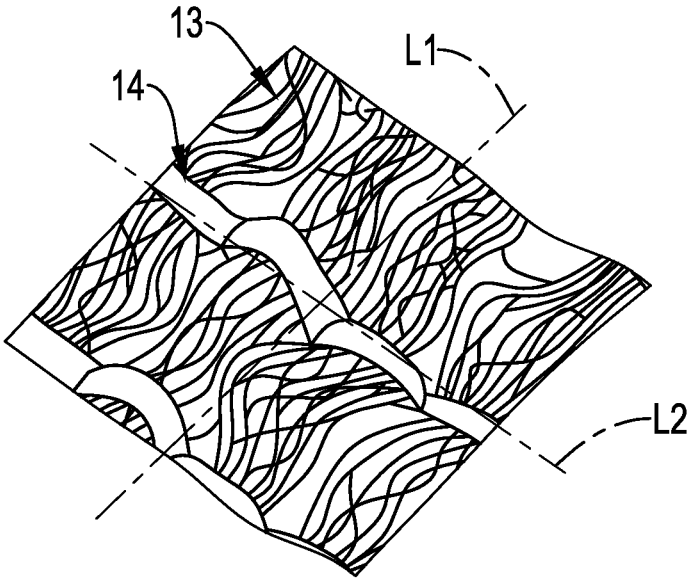
FIG. 3 is a partial enlarged view of FIG. 2B.

With reference to FIG. 2A, FIG. 2B and FIG. 3, a fabric with coffee yarns is provided in the present invention and includes a first weaving direction L1, a second weaving direction L2, a plurality of coffee yarns 13, and a plurality of weaving yarns 14. The coffee yarns 13 are arranged in parallel. The weaving yarns 14 are arranged in parallel and are crossly weaved with the coffee yarns 13. The second weaving direction L2 may intersect the first weaving direction L1. The coffee yarns 13 and the weaving yams 14 are respectively parallel to the first weaving direction L1 and the second weaving direction L2 to be crossly weaved so as to form the fabric with coffee yarns. The weaving yarns 14 may be the coffee yarns or any other kinds of yarns, and it is not limited in the present invention.

The fabric with coffee yarns made by the coffee yarns 13 with the coffee particles 12 includes many special extensive functions. For example, a portion in some of the coffee particles 12 may be exposed on a surface of the yarn body 10. Since some of the coffee particles 12 protrude from the surface of the yam body 10, an overall surface area of the coffee yarns 13 is increased. In accordance with a physical characteristic of the coffee yarns 13, the coffee yams 13 may provide an excellent moisture tension for the fabric with the coffee yarns 13. Therefore, the fabric with the coffee yams has a fast dry capability and can absorb foul odors to achieve an excellent odor control effect. The surface at each of the coffee particles 12 includes tiny pores, so ultraviolet rays can be efficiently refracted or scattered from the tiny pores and the fabric with the coffee yams has a capability of blocking ultraviolet (UV) rays.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A coffee yarn, comprising:

a yarn body having a wavy strip shape and including a plurality of bending sections and a plurality of non-bending sections; and a plurality of coffee particles embedded within the yarn body;

wherein a density of the coffee particles in the bending sections is greater than a density of the coffee particles in the non-bending sections.

2. The coffee yarn as claimed in claim 1, wherein the yarn body is made by Nylon.

3. The coffee yarn as claimed in claim 1, wherein the yarn body is made by Polyethylene.

4. The coffee yarn as claimed in claim 1, wherein the yarn body is made by Polypropylene.

5. The coffee yarn as claimed in claim 1, wherein the yarn body is made by Polyester.

6. The coffee yarn as claimed in claim 1, wherein the bending sections are respectively and alternately connected with the non-bending sections.

7. A fabric with coffee yarns, comprising:

a plurality of coffee yarns arranged in parallel, and each one of the coffee yarns including:

a yarn body in a wavy strip shape and including a plurality of bending sections and a plurality of non-bending sections; and a plurality of coffee particles embedded within the yarn body;

wherein a density of the coffee particles in the bending sections is greater than a density of the coffee particles in the non-bending sections; and a plurality of weaving yarns arranged in parallel, and the weaving yarns crossly weaved with the coffee yarns.

8. The fabric with coffee yarns as claimed in claim 7, wherein the yarn body in each one of the coffee yarns is made by Nylon.

9. The fabric with coffee yarns as claimed in claim 7, wherein the yam body in each one of the coffee yams is made by Polyethylene.

10. The fabric with coffee yarns as claimed in claim 7, wherein the yam body in each one of the coffee yarns is made by Polypropylene.

11. The fabric with coffee yams as claimed in claim 7, wherein the yam body in each one of the coffee yarns is made by Polyester.

12. The fabric with coffee yarn as claimed in claim 7, wherein the bending sections are respectively and alternately connected with the non-bending sections.

* * * * *